US012800159B2

(12) United States Patent
Factor

(10) Patent No.: US 12,800,159 B2
(45) Date of Patent: Nov. 17, 2026

(54) PASSIVE HUMIDITY CONTROL DEVICE

(71) Applicant: Charles J. Factor, W. Warwick, RI (US)

(72) Inventor: Charles J. Factor, W. Warwick, RI (US)

( * ) Notice: Subject to any disclaimer, the term of this patent is extended or adjusted under 35 U.S.C. 154(b) by 332 days.

(21) Appl. No.: 18/623,207

(22) Filed: Apr. 1, 2024

(65) Prior Publication Data

US 2024/0337397 A1 Oct. 10, 2024

Related U.S. Application Data

(60) Provisional application No. 63/494,506, filed on Apr. 6, 2023.

(51) Int. Cl.
*F24F 6/02* (2006.01)
*A24F 25/02* (2006.01)
*F24F 6/00* (2006.01)

(52) U.S. Cl.
CPC ..... *F24F 6/02* (2013.01); *A24F 25/02* (2013.01); *F24F 2006/008* (2013.01)

(58) Field of Classification Search
CPC ..... A01M 1/2044; A24F 25/00; A24F 25/02; A61L 9/04; A61L 9/042; A61L 9/122; A61L 9/127; A61L 9/14; A61L 2209/133; A61L 2209/14; F24F 6/02; F24F 2006/008; F24F 6/043
See application file for complete search history.

(56) References Cited

U.S. PATENT DOCUMENTS 1,012,494 A 12/1911 Wilson
1,540,211 A 6/1925 Gaisman
1,852,004 A 4/1932 Dunn
1,871,419 A 8/1932 McKee
2,780,489 A * 2/1957 Bosman ..... A24F 25/02 239/45
3,447,907 A * 6/1969 Bennett ..... G01N 33/0042 239/51.5
4,878,615 A * 11/1989 Losi ..... B01D 1/00 239/45
5,037,459 A 8/1991 Spruill
5,829,452 A 11/1998 Oster
5,934,773 A 8/1999 Ferrell
(Continued)

*Primary Examiner* — Qingzhang Zhou
(74) *Attorney, Agent, or Firm* — Hinckley, Allen & Snyder; Stephen J. Holmes

(57) ABSTRACT

A passive humidity control device for a cigar humidor is generally rectangular in shape and has a lower reservoir portion which serves as a storage tank for a water supply, an upper evaporation chamber and a wide, flat ribbon-like wick that has a main body portion that sits within a trough along the length of the evaporation chamber. Opposing ends of the wick extend down into the reservoir through transverse wicking slots or conduits in the trough bottom wall. A central folded portion of the wick may also extend down into the reservoir through a central wicking conduit in the trough bottom wall, essentially separating the trough into two troughs and two evaporation chambers. A salt-based evaporative control paste is coated onto the main body portion of the wick within the evaporation chambers to regulate evaporation of water from the wick to a desired humidity.

18 Claims, 8 Drawing Sheets

(56) References Cited

U.S. PATENT DOCUMENTS

| | | | | |
|---|---|---|---|---|
| 5,957,554 | A * | 9/1999 | Pendergast | A24F 25/02 261/99 |
| 6,446,880 | B1 * | 9/2002 | Schram | B05B 17/0684 239/326 |
| 7,841,586 | B1 | 11/2010 | Mongeon | |
| 8,220,782 | B2 | 7/2012 | Hepple | |
| 2012/0061486 | A1 * | 3/2012 | Atkinson | A01M 1/2044 239/34 |
| 2019/0045842 | A1 | 2/2019 | Alvez | |

* cited by examiner

PASSIVE HUMIDITY CONTROL DEVICE

CROSS-REFERENCE TO RELATED APPLICATIONS

This application claims the benefit of U.S. Provisional Patent Application No. 63/494,506, filed Apr. 6, 2023, the entire contents of which are incorporated herein by reference.

BACKGROUND OF THE INVENTION

(1) Field of the Invention

The present disclosure relates generally to humidification devices and apparatus for maintaining humidity levels in enclosed spaces and more particularly to a passive humidity control device suitable for use in a cigar humidor.

(2) Description of Related Art

It is well known that the optimum range of relative humidity for storing tobacco products, and in particular cigars, is about 67% to about 75%, with 70% being an ideal relative humidity level. Unfortunately, relative humidity varies greatly by geography and climate and despite great efforts by many, the existing solutions still have shortcomings. Known solutions have included absorbent materials which passively evaporate water, absorbent pads with electric fans to provide increased moist airflow, vibrational transducer devices with humidity sensors to selectively evaporate water from a reservoir and packages of pre-mixed water and salt which evaporate at more controlled rates. However, each suffers from the same problem, which is longevity of the water supply, a requirement for vigilant supervision of water levels and constant refilling. Most know humidification systems only last about 1-2 months before requiring a water refill.

SUMMARY OF THE DISCLOSURE

Accordingly, the industry is still searching for a new solution which provides and maintains a consistent long-term relatively humidity within the enclosed space of a humidor, or other similar space requiring long-term, stable humidity control.

A passive humidity control device in accordance with the present invention is configured and arranged for placement inside an enclosed environment, such as a cigar humidor, where it can evaporate water at a highly controlled rate and maintain a steady state humidity for a long period of time without user intervention. Cigar humidors are constructed in various sizes and of various materials. Many humidors are constructed from wood materials, and many are lined with cedar wood for its known water absorption qualities and aroma. It is also known that the seal of the humidor lid or door and the lining within the enclosed space are critical in maintaining the internal environment temperature and humidity. Finish on the outside surface of the humidor may also be critical in preventing escape of moisture. Electric cigar coolers work exceptionally well as they have good quality door seals and lined interiors. Nevertheless, each type of humidor still requires a moisture source to maintain a desired relative humidity over time. The present device is well suited for use in any type of humidor.

The passive humidity control device is generally rectangular in shape, similar to the length and width of two medium cigars, and comprises a lower reservoir portion which serves as a storage tank or reservoir for a water supply, an upper evaporation chamber and a wide, flat ribbon-like wick that has a main or central body portion that sits within a trough along the length of the evaporation chamber and opposing feed ends which extend down into the reservoir and water supply through transverse wicking slots or conduits in the trough bottom wall. A central folded portion of the wick may also extend down into the reservoir through a central wicking conduit (slot) in the trough bottom wall, essentially separating the trough into two troughs and two evaporation chambers. A salt-based paste or gel is coated onto the main body portion of the wick within the evaporation chambers to regulate evaporation of water from the wick to a desired humidity. Different salt formulations can be utilized to provide a desired humidity level. The width and length of the wick within the evaporation chambers provides large evaporative surface areas as well as a larger wicking area for delivery of water from the reservoir to the main body portion of the wick within the trough. The central portion of the wick that extends downwardly into the reservoir maintains the center portion of the wick moist and prevents the center from drying out.

In an exemplary embodiment, the reservoir portion and the evaporation chambers are defined by 3 housing elements, namely lower body (upwardly open reservoir), a middle body defining two upwardly open troughs and a top cover or grill with evaporation vents.

The lower body is generally rectangular and open at the top thereby defining a reservoir which can hold a quantity of water or fluid. In the exemplary embodiments, the fluid comprises cedar water, which is water infused with cedar oils that act as anti-microbial agents. Other anti-microbial fluids may also be utilized.

The middle body is received over the open top of the lower body to enclose the reservoir chamber. An O-ring seal is received between the shoulders of the lower body and the middle body to form a water tight seal around the outer periphery of the reservoir. The middle body has two spaced trough portions situated between a central wicking slot and two opposing end wicking slots which receive downwardly extending portions of the wick. Additionally, on the respective inward sides of the slots there are upstanding dam or shoulder walls over which the wick is guided before turning downward into the slots.

The ribbon-like wick is constructed from an absorbent material which is capable of wicking water from the reservoir and retaining a level of moisture along its entire length so long as the ends are submerged within the water level within the reservoir below. In this regard, central portions of the wick are laid flat within the trough areas of the middle body and the terminal ends are threaded over the dams and downwardly into the reservoir where they are at least partially submerged in the water supply.

A central portion of a continuous wick may be folded over on itself, threaded through a central wicking conduit and extend downwardly into the reservoir. The central wicking conduit also includes shoulder walls so that each end of the respective trough has a respective shoulder wall. Capillary forces wick the water up through the wick material and wet the entire surface of the wick. The central folded section along with the two opposing ends provides wicking from both ends of both troughs to maintain the wick consistently and evenly wet across its entire length.

An evaporation control paste/gel is coated onto the surface of the main body of the wick within the two spaced troughs. The evaporation control paste is a salt-based paste which may contain various types of salts blended to a mixture which will provide controlled evaporation to a desirable relative humidity. Salts may be selected from the group comprising sodium, calcium, potassium and magnesium based salts, and combinations thereof, as well as others. As noted above, different salt formulations can be utilized to provide desired humidity levels.

In order to maintain a homogenous dispersion of salt and a uniform evaporation rate over the surface of the wick, the salt mixture is blended with a thickener, such as corn starch, which binds the salt mixture together and maintains homogeneity.

As water evaporates from the paste-coated wick to maintain humidity, the wick draws water from the reservoir to maintain the surface of the wick moist, until the relative humidity within the enclosed space reaches an equilibrium.

To further maintain a level of moisture within the paste coating, some embodiments may include cedar wood shavings dispersed throughout the coating. These shavings absorb and retain moisture even in situations of very low relative humidity where water is evaporating faster than the wick can feed from reservoir.

The cover is received over the middle body to define the evaporation chambers together with the middle body. The cover includes downwardly depending shoulder walls which are received in spaced relation within the trough shoulder walls. In particular, it is noted that the end shoulder walls are received in spaced relation and cooperate to capture the wick across its width and retain the wick in place in an inverted U-shaped conduit. The top wall of the cover includes a plurality of evaporation vents within the boundaries of shoulder walls which allow the exchange of air between the evaporation chambers and the ambient environment within the humidor.

A planar sealing gasket is received between the flat surfaces of the outer peripheral edges of the middle body and cover to form another water tight seal. In this regard, only the moist paste is exposed to ambient air.

The device further includes a fill port which may be located in any one of the top surfaces of the device. In an exemplary embodiment, the fill port is located within an end portion of the middle body. A rotatable locking bung or stopper passes through a hole in the cover and the sealing gasket and is rotated to lock the bung into place.

The large exposed surface areas of the wick provides an ideal interface for the device to evaporate moisture into the enclosed space of the humidor and to maintain a relative humidity with little intervention from the user. As long as there is a relatively good seal and lining within the humidor to prevent moister escaping from the humidor itself, the original supply of water has been found to provide a stable level of humidity for long periods of time without refill. It can be appreciated that the larger wick surface area and paste coating also contributes to reabsorption of moisture from the air back to the wick when the humidity increases. This reverse wicking helps retain the water supply within the device and lengthen the time periods between refills.

Most importantly, it can be appreciated that the device is entirely passive in nature without any moving parts or the requirement of any electrical power. Once filled with a water supply, the device uses the natural properties of capillary wicking and the salt-based evaporative control paste to achieve and maintain a desired relative humidity in the enclosed space of a humidor.

For a better understanding of the invention, its operating advantages and the specific objectives attained by its uses, reference should be had to the accompanying drawings and descriptive matter in which there is illustrated a preferred embodiment of the invention.

BRIEF DESCRIPTION OF THE DRAWING FIGURES

In the drawings which illustrate the best mode presently contemplated for carrying out the present invention:

DETAILED DESCRIPTION OF THE EXEMPLARY EMBODIMENTS

Figure 1:
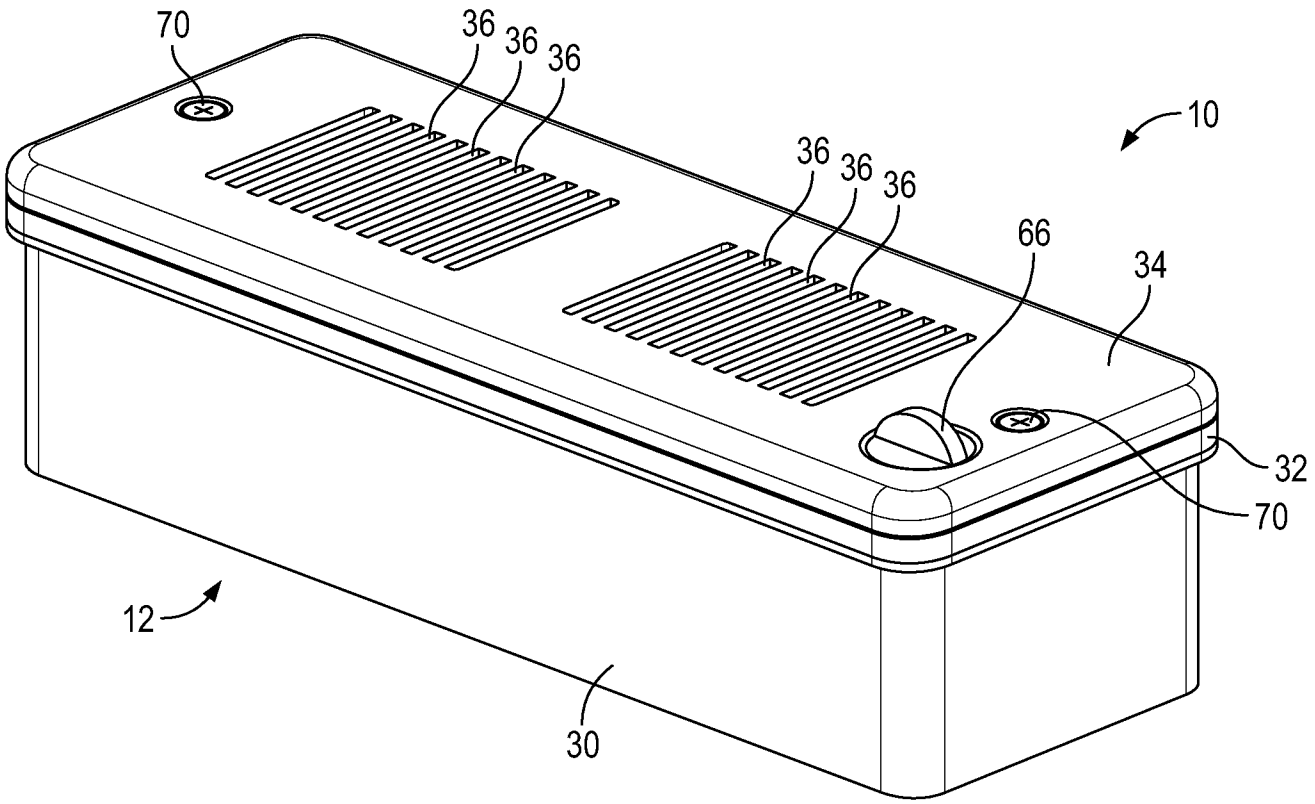
FIG. 1 is a perspective view of an exemplary passive humidity control device in accordance with the teaching of the present invention.
Figure 2:
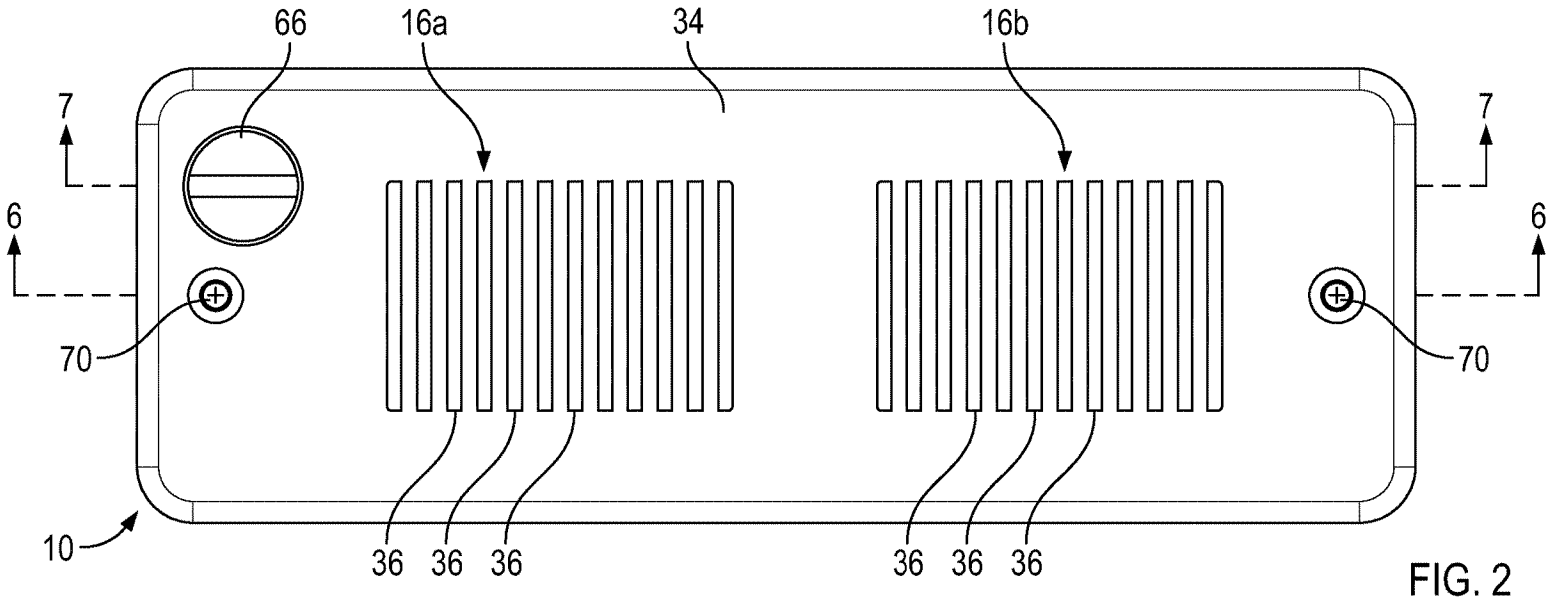
FIG. 2 is a top view thereof.
Figure 3:
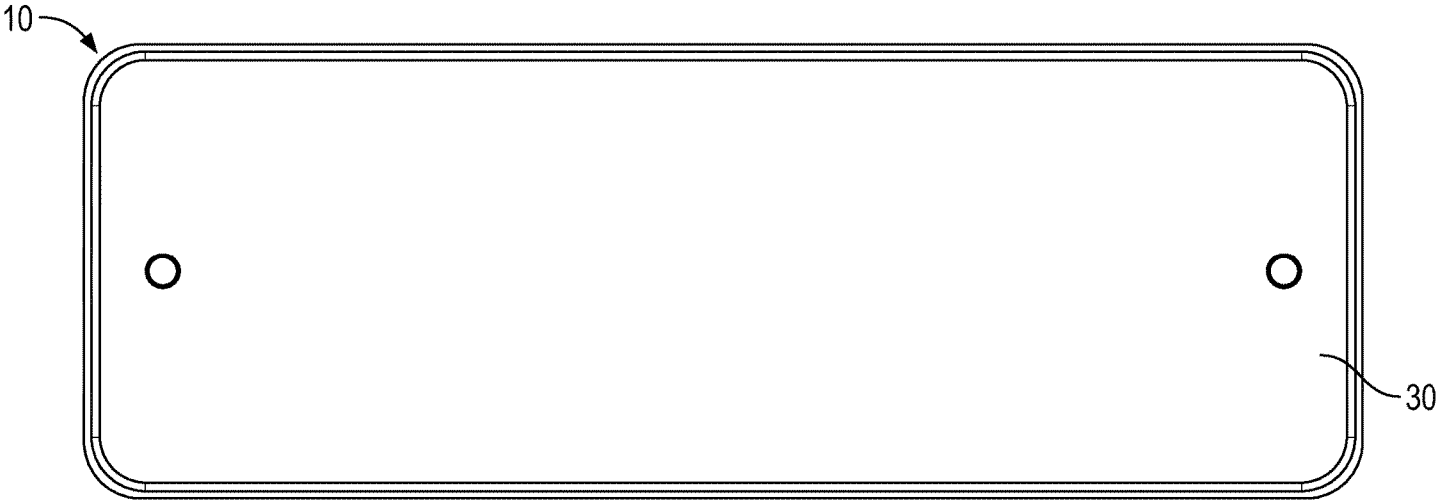
FIG. 3 is a bottom view thereof.
Figure 4:
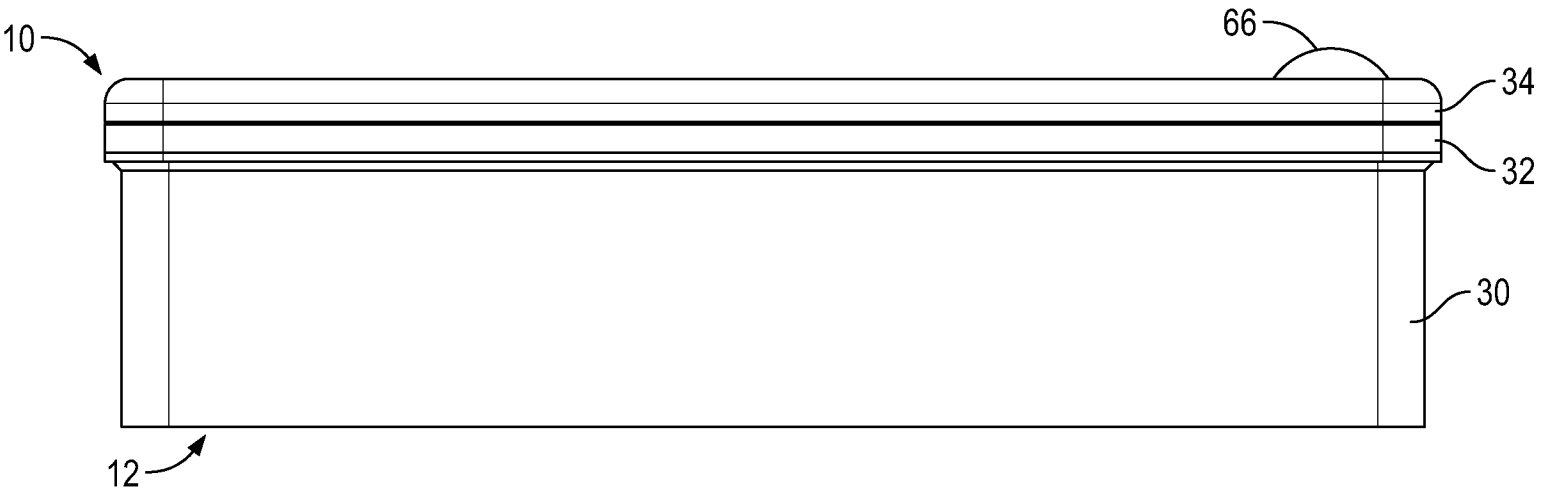
FIG. 4 is a front view thereof.
Figure 5:
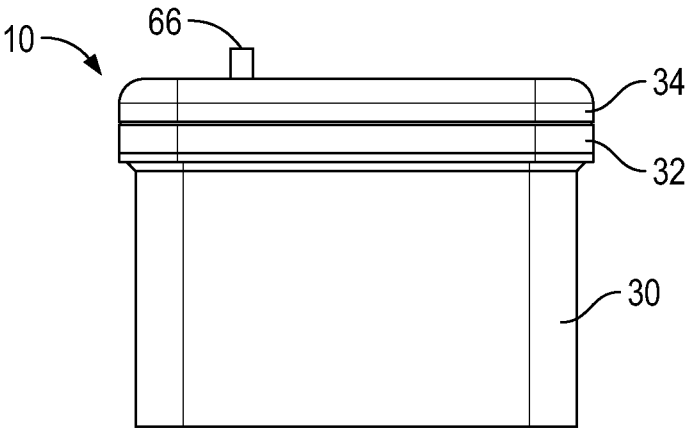
FIG. 5 is an end view thereof.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Referring to drawings FIGS. 1-10, a passive humidity control device in accordance with the present invention is illustrated and generally indicated at 10.

The humidity control device 10 is particularly configured and arranged for placement inside an enclosed environment, such as a cigar humidor (now shown), where it can evaporate water at a highly controlled rate and maintain a steady state humidity for a long period of time without user intervention.

Cigar humidors may be constructed in various sizes and of various materials. Many humidors are constructed from wood materials, and many are lined with cedar wood for its known water absorption qualities and aroma. The present device is well suited for use in any type of humidor.

The passive humidity control device 10 is generally rectangular in shape, similar to the length and width of two medium cigars. The illustrated embodiment also generally has a height equal to two cigars, so roughly occupying the space of about 4 bundled cigars. The specific length, width and height may be variable, depending on the size of the interior space in which the device is being utilized.

The device 10 comprises a lower reservoir portion 12 which serves as a storage tank or reservoir for a water supply 14, upper evaporation chambers 16*a*, 16*b* and a wide, flat ribbon-like wick 18 that has a main or central body portion sits within troughs 20*a*, 20*b* along the length of the evaporation chamber 16*a*, 16*b* and opposing feed ends which extend down into the reservoir 12 and water supply 14 through transverse wicking conduits 22, 24 in bottom walls of the troughs. In the exemplary embodiment, the there are two separated evaporation chambers 16*a*, 16*b* and a central folded portion of the wick 18 extends down into the reservoir 12 through a central wicking conduit (slot) 26 in the trough bottom walls. In this regard, the central wicking 26 conduit separates the two troughs 20*a*, 20*b*. A salt-based paste 28 or gel is coated onto the main body portions of the wick 18 within the evaporation chambers 16*a*, 16*b* to regulate evaporation of water from the wick 18 to a desired humidity. Different salt formulations can be utilized to provide a desired humidity level. The width and length of the wick 18 within the evaporation chambers 16*a*, 16*b* provides large evaporative surface areas as well as a larger wicking area for delivery of water from the reservoir 12 to the main body portion of the wick 18 within the troughs. In the exemplary illustrated embodiment, the central portion of the wick 18 that extends downwardly into the reservoir 12 provides a second capillary feed point and maintains the center portion of the wick 18 moist, preventing it from drying out.

Figure 8:
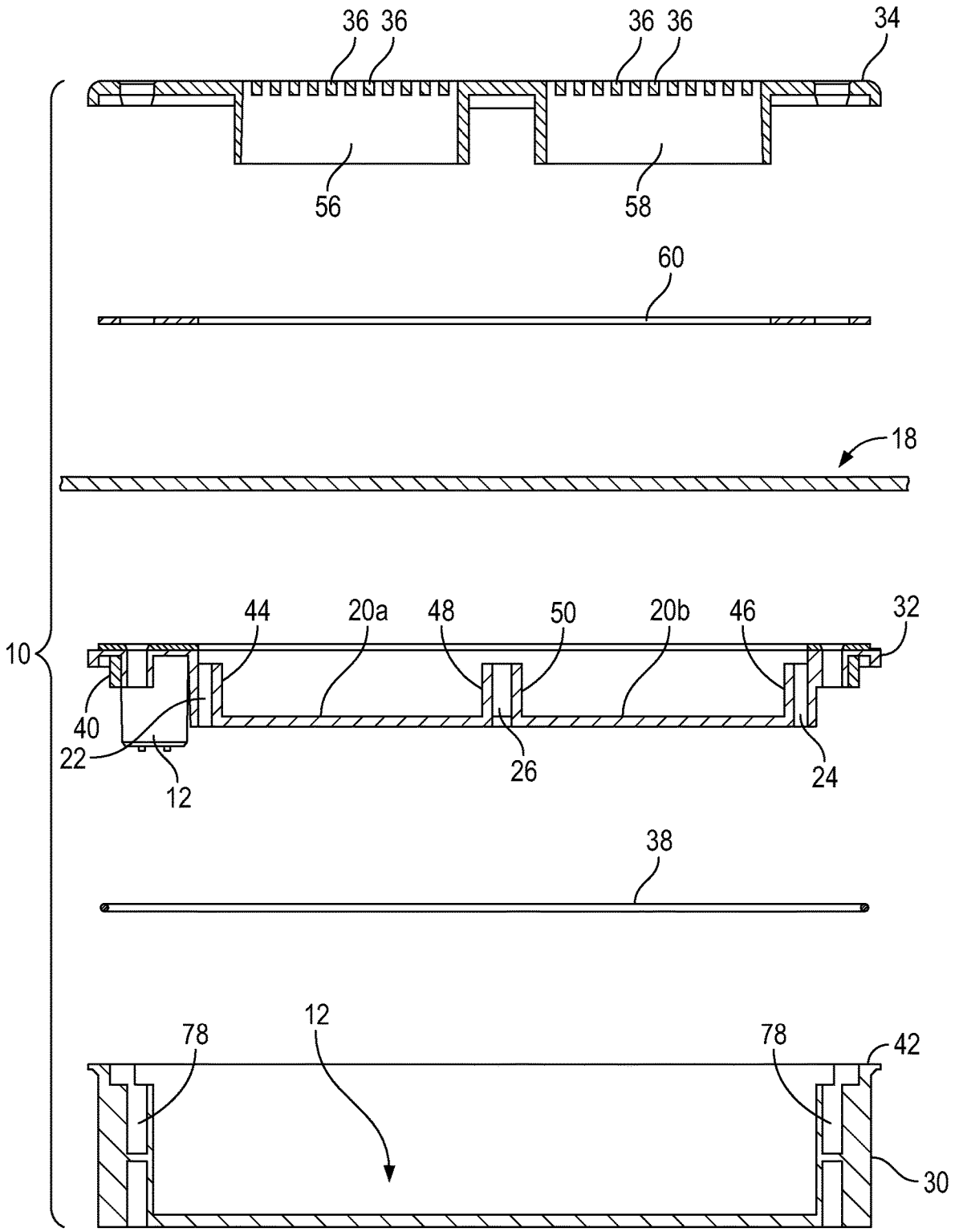
FIG. 8 is an exploded cross-sectional view thereof.
Figure 9:
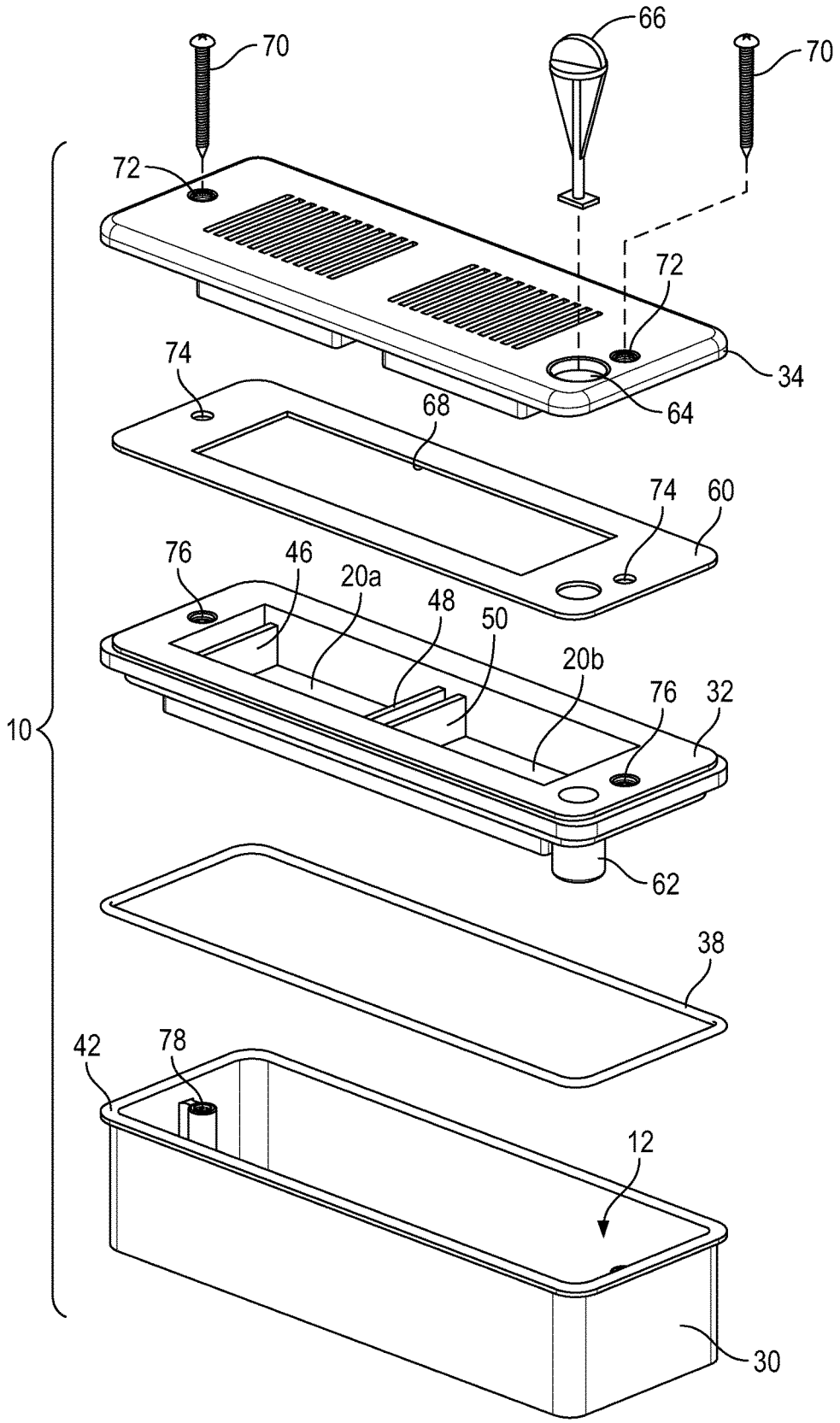
FIG. 9 is a top exploded view thereof.
Figure 10:
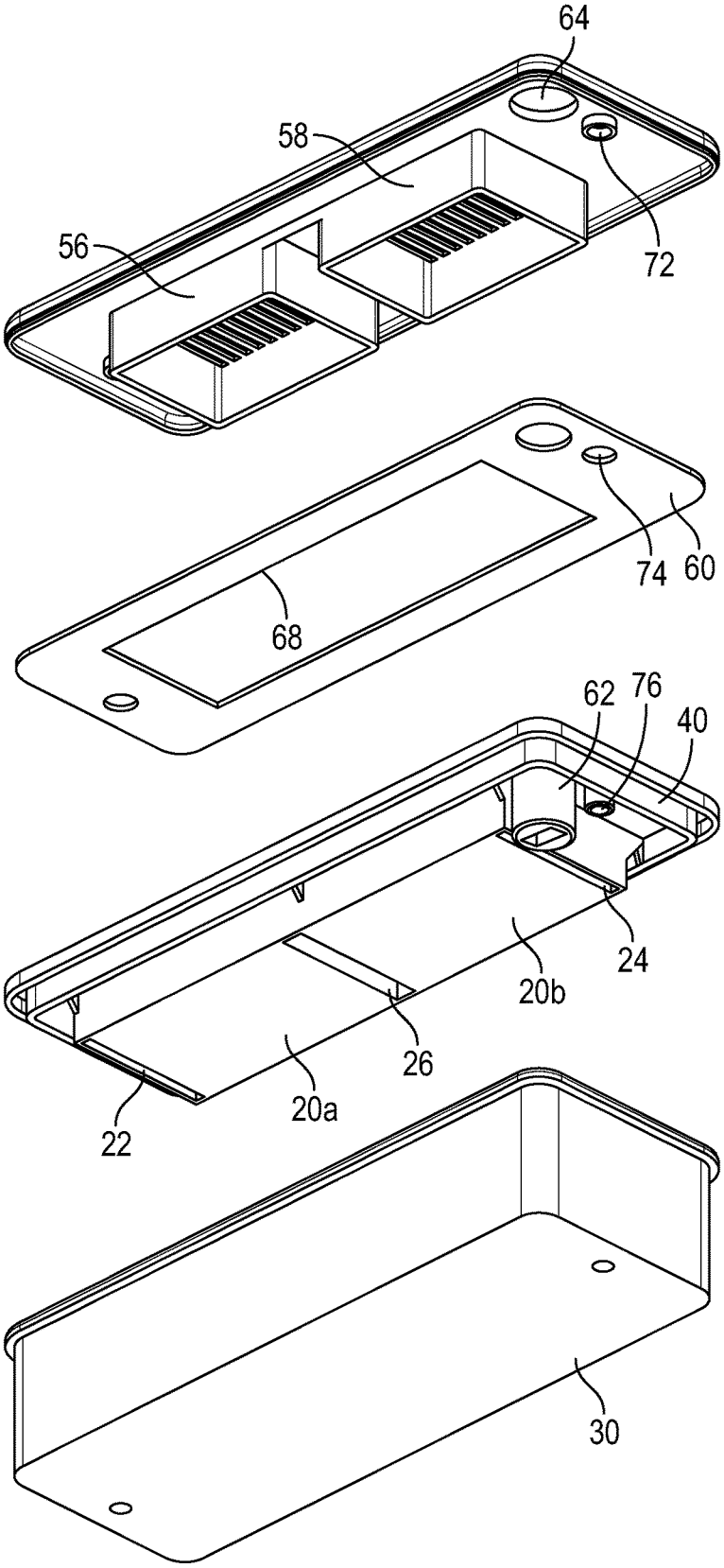
FIG. 10 is a bottom exploded view thereof.

Referring in particular to FIGS. 8-10, the reservoir portion 12 and the evaporation chambers 16*a*, 16*b* are defined by 3 housing elements, namely lower body 30 (upwardly open reservoir), a middle body 32 defining the two upwardly open troughs 20*a*,20*b* and a top cover 34 or grill with evaporation vents 36. The body portions 30, 32, 24 may be molded, or otherwise fabricated or formed from suitable non-porous plastic materials as well as other suitable non-porous composite or metal materials.

The lower body 30 is generally rectangular with a bottom wall, sidewalls and open at the top thereby defining the reservoir 12 which can hold a quantity of water 14 or other evaporation fluid. In the exemplary embodiments, the fluid comprises cedar water, which is water infused with cedar oils that act as anti-microbial agents. Other anti-microbial fluids may also be utilized.

The middle body 32 is received over the open top of the lower body 30 and cooperates with the lower body 30 to enclose and define the reservoir tank 12. A rubber O-ring seal 38 or gasket is received in a groove 40 (See FIGS. 6 and 10) in the periphery of the bottom wall of the middle body 32 and engages with an outwardly turned peripheral upper lip 42 of the lower body 30 to form a water tight seal around the outer periphery of the reservoir 12. The top surface of the middle body 32 has two spaced trough portions 20*a*,20*b* situated between the central wicking conduit 26 and the two opposing end wicking conduits 22, 24 which receive downwardly extending portions of the wick 18. Additionally, on the respective inward sides of each of the conduits 22, 24 there are upstanding dam or shoulder walls 44, 46 over which the continuous length of the wick 18 is guided before turning downward through the conduits 22,24.

The ribbon-like wick 18 is preferably a continuous, flat web structure constructed from an absorbent fibrous material which is capable of wicking water 14 from the reservoir 12 and retaining a level of moisture along its entire length so long as portions of the continuous web are submerged within the water level within the reservoir below. In this regard, evaporative sections of the wick 18 are laid flat within the trough areas 20*a*, 20*b* of the middle body 32 and the opposing terminal ends are threaded over the dam shoulders 44, 46 and downwardly into the reservoir 12 where they are at least partially submerged in the water supply 14.

Figure 6:
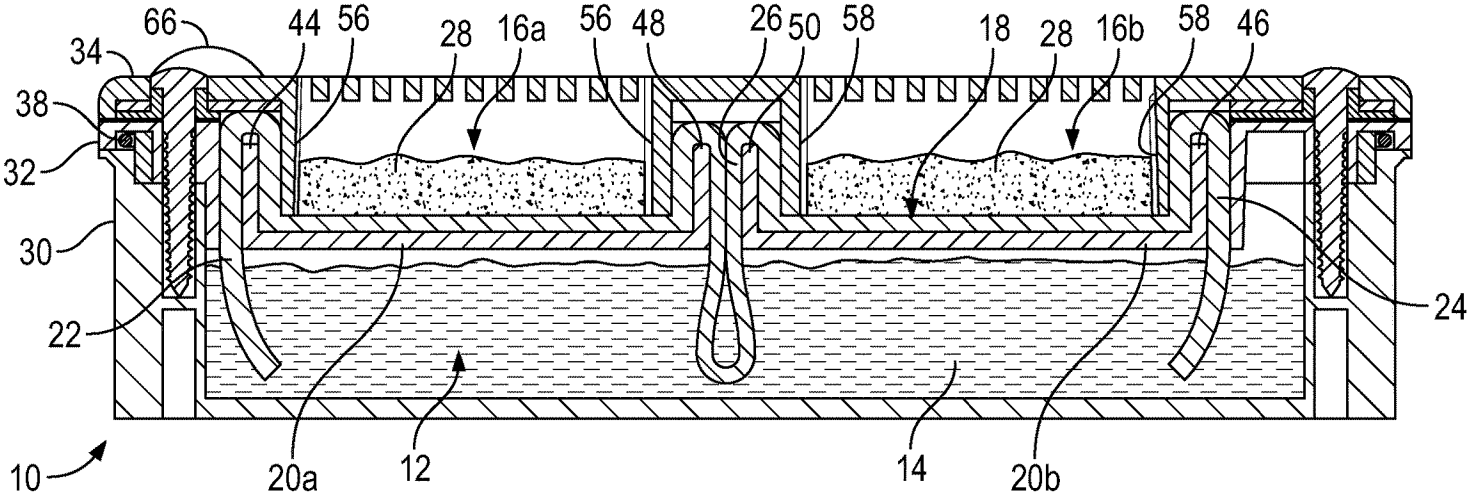
FIG. 6 is a cross-sectional view thereof taken along line 6-6 of FIG. 2.
Figure 7:
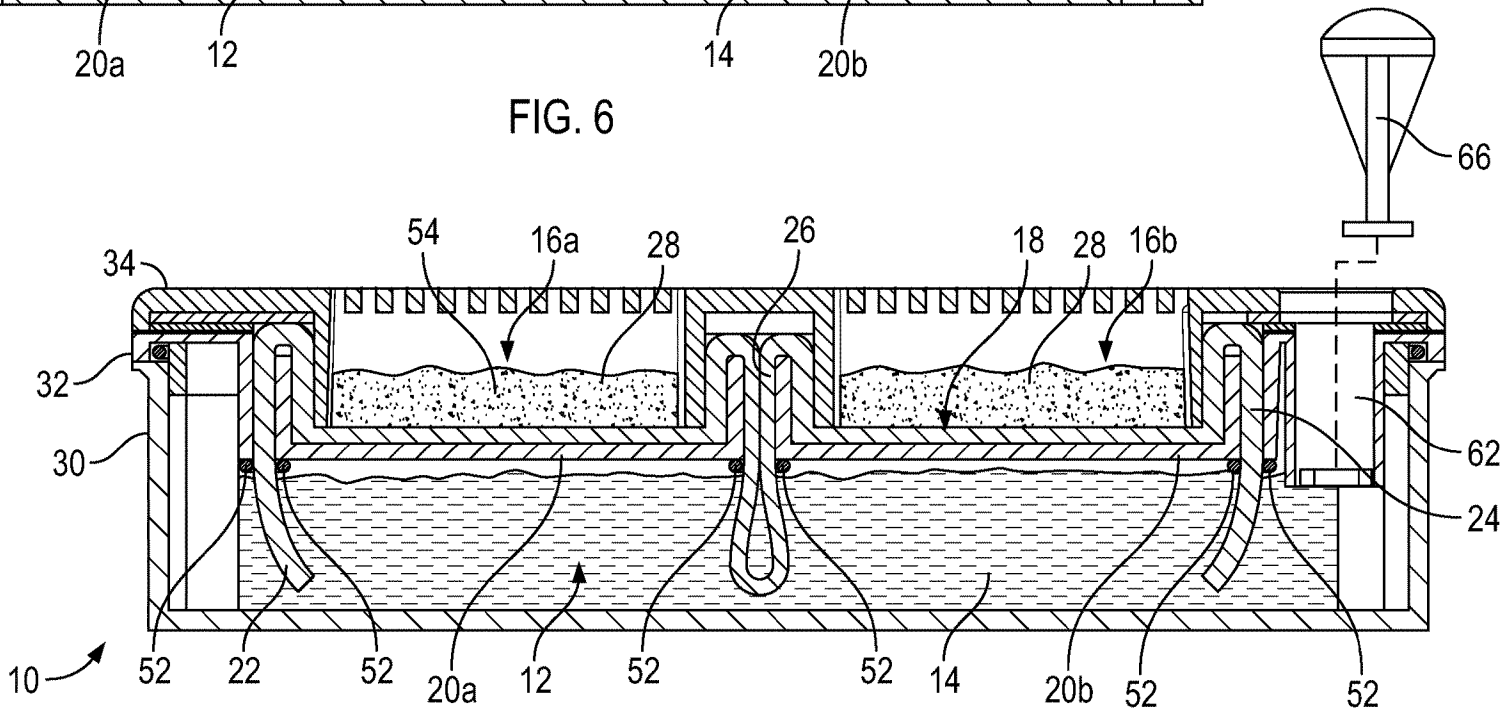
FIG. 7 is another cross-sectional view thereof taken along line 7-7 of FIG. 2.

Further, a central portion of a continuous wick 18 may be folded over on itself, threaded through a central wicking conduit 26 and extend downwardly into the reservoir 12 (see FIGS. 6 and 7). The central wicking conduit 26 also includes upward shoulder walls 48, 50 so that each end of the respective trough 20*a*, 20*b* has a respective shoulder wall (44, 48 and 46, 50). The wick 18 may be secured in place by beads 52 of flexible adhesive (See FIG. 7), such as silicone, or hot melt glue, deposited along selected edges of the wicking conduits and at the bases of the shoulder walls. Capillary forces wick the water up through the wick material and wet the entire surface of the wick 18. The central folded section of the wick 18 along with the two opposing ends provides capillary wicking action from both ends of both troughs 20*a*, 20*b* to maintain the wick 18 consistently and evenly wet across its entire length.

Still referring to FIGS. 6 and 7, the evaporation control paste/gel 28 is coated or deposited onto the upper surfaces of the wick 18 as located within the two spaced troughs 20*a*, 20*b*. The evaporation control paste 28 is a salt-based paste which may contain various combinations of salts blended into a mixture which, based on its particular mixture, provides controlled evaporation to a desirable relative humidity. Preferably, the evaporation paste may be effective to achieve a relative humidity in a range between 65% and 75% inclusive, more preferably in a range between 69% and 71% inclusive, and still more preferably about 70%. Exemplary salts may be selected from the group consisting of sodium, calcium, potassium and magnesium based salts, and combinations thereof, as well as others. As noted above, different salt formulations can be utilized to provide desired humidity levels and can be interchanged throughout the course of a year as relative environmental humidity changes.

In order to maintain a homogenous dispersion of salt and a uniform evaporation rate over the surface of the wick 18, the salt mixture is blended with a thickener, such as corn starch for example, which binds the salt mixture together and maintains homogeneity.

As water evaporates from the paste-coated wick to maintain humidity, the wick 18 draws water 14 from the reservoir 12 to maintain the surface of the wick moist, until the relative humidity within the enclosed space reaches an equilibrium.

To further maintain a level of moisture within the paste coating 28, some embodiments may include cedar wood shavings 54 dispersed throughout the control paste. These shavings 54 absorb and retain moisture even in situations of very low relative humidity where water is evaporating faster than the wick can feed from reservoir.

The cover 34 is received over the middle body 32 to define the evaporation chambers 16*a*, 16*b* together with the middle body 32. The cover 34 includes downwardly depending rectangular-shaped shoulder walls 56, 58 which are respectively received in closely spaced relation within the side walls of the troughs 20*a*, 20*b* and in spaced facing relation within the trough shoulder walls 44, 48 and 46, 50. In particular, it is noted that the facing shoulder walls at each end of the respective troughs cooperate to capture the wick 18 across its width and retain the wick 18 in place in an inverted U-shaped wicking conduit (Sec FIGS. 6 and 7). The wicking conduits 22, 24, 26 are roughly the same dimension as the thickness of the wick 18 such that the wetted wick 18 occupies the entirety of the conduit space and create seals between the evaporation chambers 16*a*, 16*b* and the reservoir chamber 12 to prevent unwanted excess evaporation.

The top wall of the cover 34 includes a plurality of evaporation vents 36 positioned within the boundaries of shoulder walls 56, 58 which allow the exchange of air between the evaporation chambers 16*a*, 16*b* and the ambient environment within the humidor.

A planar elastomeric scaling gasket 60 is received between the flat surfaces of the upper peripheral edges of the middle body 32 and the lower peripheral edges of the cover 34 to form another water tight seal between the two bodies. The gasket is provided with an appropriate opening to extend around the shoulder walls 56, 58. In this regard, only the wetted wick 18 and paste 28 are exposed to ambient air through the vents 36.

The device 10 further includes a fill port 62 which may be located in any one of the top surfaces of the device. In an exemplary embodiment, the fill port 62 is located within an end portion of the middle body 32 extending downwardly into the reservoir 12. An aligned access opening 64 is provided in the cover 34. A rotatable locking bung or stopper 66 passes through the opening 64 in the cover 34 and an opening 68 in the sealing gasket 60 and is rotatable to lock the bung 66 into place. The t-shaped terminal end of the locking plug 66 and the bottom wall of the fill port 62 may have complementary cam surfaces to compress the stopper 66 down into the gasket 68 and provide a secure seal.

The three housing bodies 30, 32, 34 are secured together with threaded fasteners 70 that are extended through aligned openings 72, 74, 76 in the cover 34, gasket 60, and middle body 32 into aligned receiving bores 78 in the lower body 30.

The large exposed surface areas of the wick 18 provide an ideal interface for the device 10 to passively evaporate moisture into the enclosed space of the humidor and to maintain a relative humidity with little intervention from the user. As long as there is a relatively good seal and lining within the humidor to prevent moister escaping from the humidor itself, the original supply of water has been found to provide a stable level of humidity for long periods of time without refill. It can be appreciated that the larger flat wick surface area and paste 28 coating also contributes to reabsorption of moisture from the air back to the wick when the humidity increases. This reverse wicking helps retain the water supply within the device and lengthen the time periods between refills.

Most importantly, it can be appreciated that the device is entirely passive in nature without any moving parts or the requirement of any electrical power. Once filled with a water supply, the device 10 uses the natural passive action of capillary wicking and the salt-based evaporative control paste 28 to achieve and maintain a desired relative humidity in the enclosed space of a humidor.

Figure 11:
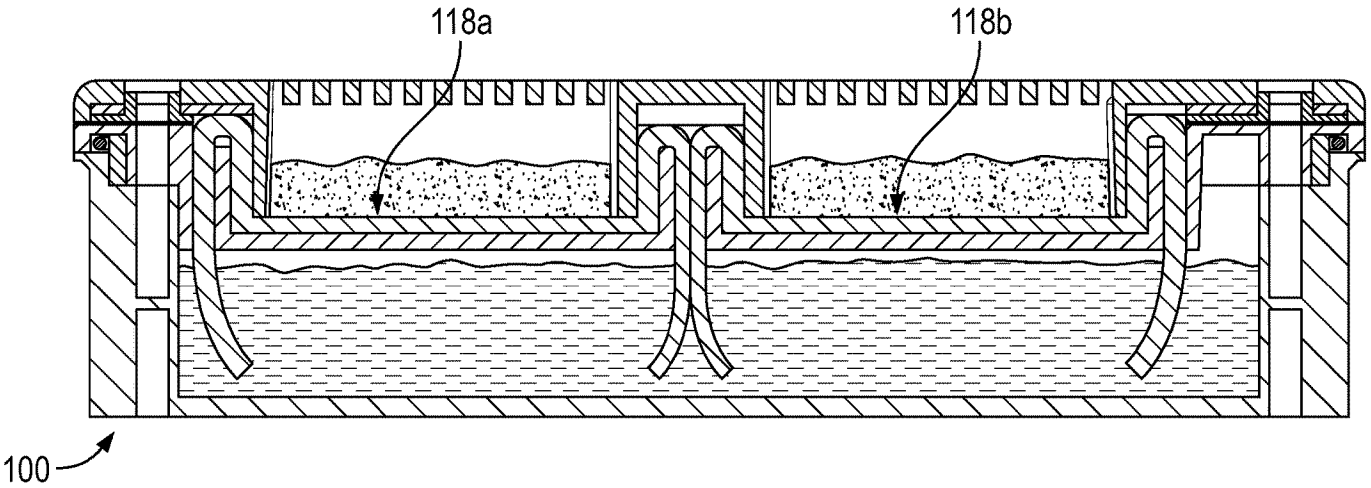
FIG. 11 is a cross-sectional view of another exemplary embodiment including two separate wick segments.

Referring now to FIG. 11, another exemplary embodiment is illustrated and generally indicated at 100. The illustrated embodiment 200 is nearly identical to the embodiment 100 described hereinabove, with the exception that the wick 18 is divided into two separate webs 118*a* and 118*b* of material. The earlier described embodiment 10 illustrates the wick 18 as a continuous web, which facilitates manufacture and assembly. However, the invention is equally effective with two separate wick elements 118*a*, 118*b*, so long as the opposed terminal end portions have a suitable surface area submerged within the water supply.

Figure 12:
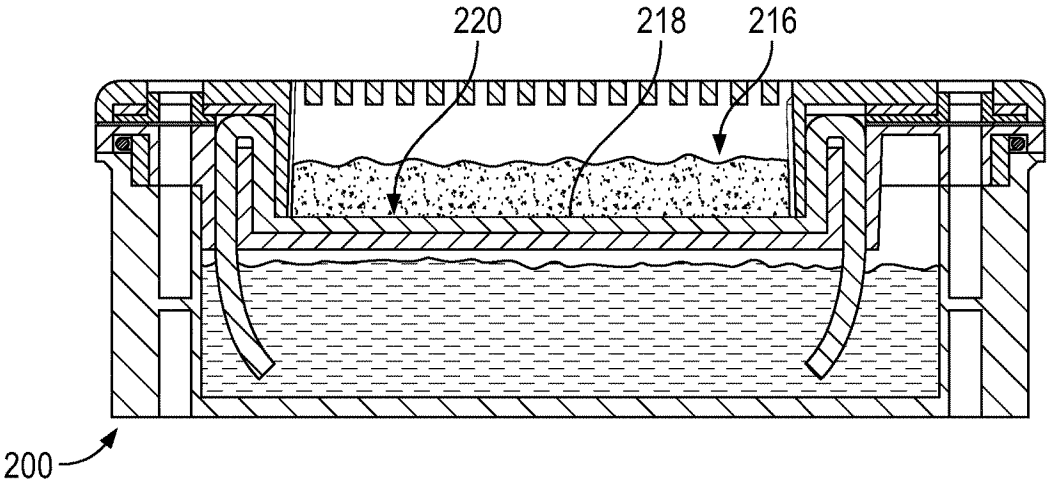
FIG. 12 is a cross-sectional view of yet another exemplary embodiment including only a single evaporation chamber.

Referring now to FIG. 12, yet another exemplary embodiment is illustrated and generally indicated at 200. The illustrated embodiment 200 is also nearly identical to the embodiment 100 described hereinabove, with the exception that the overall size of the device 200 is shorter and includes only a single evaporation chamber 216 and a single trough 220. In this regard, the terminal ends of the wick 218 extend into the water supply and because the length of the trough 220 and wick 218 are shorter, the wick 218 may stay sufficiently wetted without the central portion of the wick 218 providing a secondary wicking source. Accordingly, the central wicking conduit is eliminated.

While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described.

What is claimed is:

1. A passive humidity control device comprising:

a water reservoir;

an evaporation chamber above the water reservoir, the evaporation chamber including an elongated upwardly open trough and a plurality of vents above the trough;

an elongated ribbon-like wick having a central portion disposed within and extending along a bottom wall of the trough, the wick further having a first end portion extending downwardly into the water reservoir through a first wicking conduit at a first end of the trough, and a second end portion extending downwardly into the water reservoir through a second wicking conduit at a second end of the trough; and a salt-based evaporative control paste covering the central portion of the wick extending within the trough, wherein water contained within the water reservoir is transferred into the evaporation chamber by capillary action through the wick, and wherein evaporation of water from the wick is regulated by the evaporative control paste to achieve a predetermined humidity level within an enclosed space in which the device is located.

2. The passive humidity control device of claim 1, wherein the bottom wall of the trough includes a first shoulder wall adjacent the first wicking conduit and a second should wall adjacent the second wicking conduit, the first and second ends of the wick extending upwardly over the respective first and second shoulder walls and downwardly into the water reservoir through the respective wicking conduits.

3. The passive humidity control device of claim 1, wherein the trough further includes a central wicking conduit between the first and second ends thereof, and the central portion of the wick extends downwardly into the water reservoir through the central wicking conduit.

4. The passive humidity control device of claim 2, wherein the trough further includes a central wicking conduit between the first and second ends thereof, and the central portion of the wick extends downwardly into the water reservoir through the central wicking conduit.

5. The passive humidity control device of claim 4, wherein the bottom wall of the trough further includes first and second central shoulder walls adjacent opposing sides of the central wicking conduit, and the central portion of the wick extends upwardly over the respective first and second central shoulder walls and downwardly into the water reservoir through the central wicking conduit.

6. The passive humidity control device of claim 3, wherein the wick is a continuous web and the central portion of the wick is folded on itself and extended through the central wicking conduit.

7. The passive humidity control device of claim 4, wherein the wick is a continuous web and the central portion of the wick is folded on itself and extended through the central wicking conduit.

8. The passive humidity control device of claim 5, wherein the wick is a continuous web and the central portion of the wick is folded on itself and extended through the central wicking conduit.

9. The passive humidity control device of claim 1, wherein the salt-based evaporative control paste comprises salts selected from the group consisting of: sodium salts, calcium salts, potassium salts and magnesium salts, and combinations thereof.

10. The passive humidity control device of claim 1, wherein the salt-based evaporative control paste includes a thickener to maintain a homogenous distribution of salts within the paste.

11. The passive humidity control device of claim 9, wherein the salt-based evaporative control paste includes a thickener to maintain a homogenous distribution of salts within the paste.

12. The passive humidity control device of claim 3, wherein the salt-based evaporative control paste comprises salts selected from the group consisting of: sodium, calcium, potassium and magnesium salts, and combinations thereof.

13. The passive humidity control device of claim 12, wherein the salt-based evaporative control paste includes a thickener to maintain a homogenous distribution of salts within the paste.

14. The passive humidity control device of claim 4, wherein the salt-based evaporative control paste comprises salts selected from the group consisting of: sodium, calcium, potassium and magnesium salts, and combinations thereof.

15. The passive humidity control device of claim 14, wherein the salt-based evaporative control paste includes a thickener to maintain a homogenous distribution of salts within the paste.

16. The passive humidity control device of claim 1, wherein the salt-based evaporative control paste is effective for achieving a humidity level in a range between and including 65% and 75%.

17. The passive humidity control device of claim 16, wherein the salt-based evaporative control paste is effective for achieving a humidity level in a range between and including 69% and 71%.

18. The passive humidity control device of claim 1, wherein the water reservoir includes a filling port, and a removable filling port bung.

* * * * *